US006202245B1

(12) United States Patent
Khodadadi

(10) Patent No.: US 6,202,245 B1
(45) Date of Patent: Mar. 20, 2001

(54) MUSICAL TOOTHBRUSH

(76) Inventor: Ramin Khodadadi, 3525 Sawtelle Blvd. #202, Los Angeles, CA (US) 90066

( * ) Notice: Subject to any disclaimer, the term of this patent is extended or adjusted under 35 U.S.C. 154(b) by 0 days.

(21) Appl. No.: 09/263,283

(22) Filed: Mar. 5, 1999

(51) Int. Cl.[7] ..... A46B 9/04

(52) U.S. Cl. ..... 15/105; 15/145; 15/167.1; 15/176.2; 403/299

(58) Field of Search ..... 15/105, 167.1, 15/145, 176.1, 176.2; 84/94.2; 446/404; 434/263; 403/299, 306, 326

(56) References Cited

U.S. PATENT DOCUMENTS

| | | | | |
|---|---|---|---|---|
| 2,114,149 | * | 4/1938 | Pensky | 15/145 |
| 2,294,631 | * | 9/1942 | Rocca | 15/145 |
| 2,306,482 | * | 12/1942 | Livingston | 15/167.1 |
| 2,512,935 | * | 6/1950 | Hansen | 15/145 |
| 2,582,404 | * | 1/1952 | Zavada | 15/167.1 |
| 3,369,265 | * | 2/1968 | Halberstadt et al. | 15/145 |
| 4,003,668 | * | 1/1977 | Kelly, III et al. | 403/299 |
| 4,341,230 | * | 7/1982 | Siahou | 15/167.1 |
| 4,371,282 | * | 2/1983 | Sturm | 15/145 |
| 4,744,124 | * | 5/1988 | Wang et al. | 15/105 |
| 5,044,037 | * | 9/1991 | Brown | 15/105 |
| 5,385,420 | * | 1/1995 | Newman, Sr. et al. | 15/145 |
| 5,564,152 | * | 10/1996 | Jeannet et al. | 15/167.1 |
| 5,572,762 | * | 11/1996 | Scheiner | 15/105 |
| 5,894,453 | * | 4/1999 | Pond | 15/105 |
| 5,924,159 | * | 7/1999 | Haitin | 15/105 |
| 5,960,507 | * | 10/1999 | Dutra et al. | 15/105 |

* cited by examiner

*Primary Examiner*—Robert J. Warden, Sr.
*Assistant Examiner*—Theresa T. Snider
(74) *Attorney, Agent, or Firm*—Goldstein & Canino

(57) ABSTRACT

A musical toothbrush including a handle. A coupling member couples with an open upper end of the handle. A brush portion detachably mates with the coupling member. A digital sound generator is disposed interiorly of the handle. The digital sound generator is coupled with a power source positioned within the handle. A speaker is disposed within the handle. An activation button couples with the digital sound generator. Pressing inwardly on the activation button will activate the digital sound generator to emit a tune through the speaker and releasing the activation button will deactivate the digital sound generator.

3 Claims, 2 Drawing Sheets

FIG 1
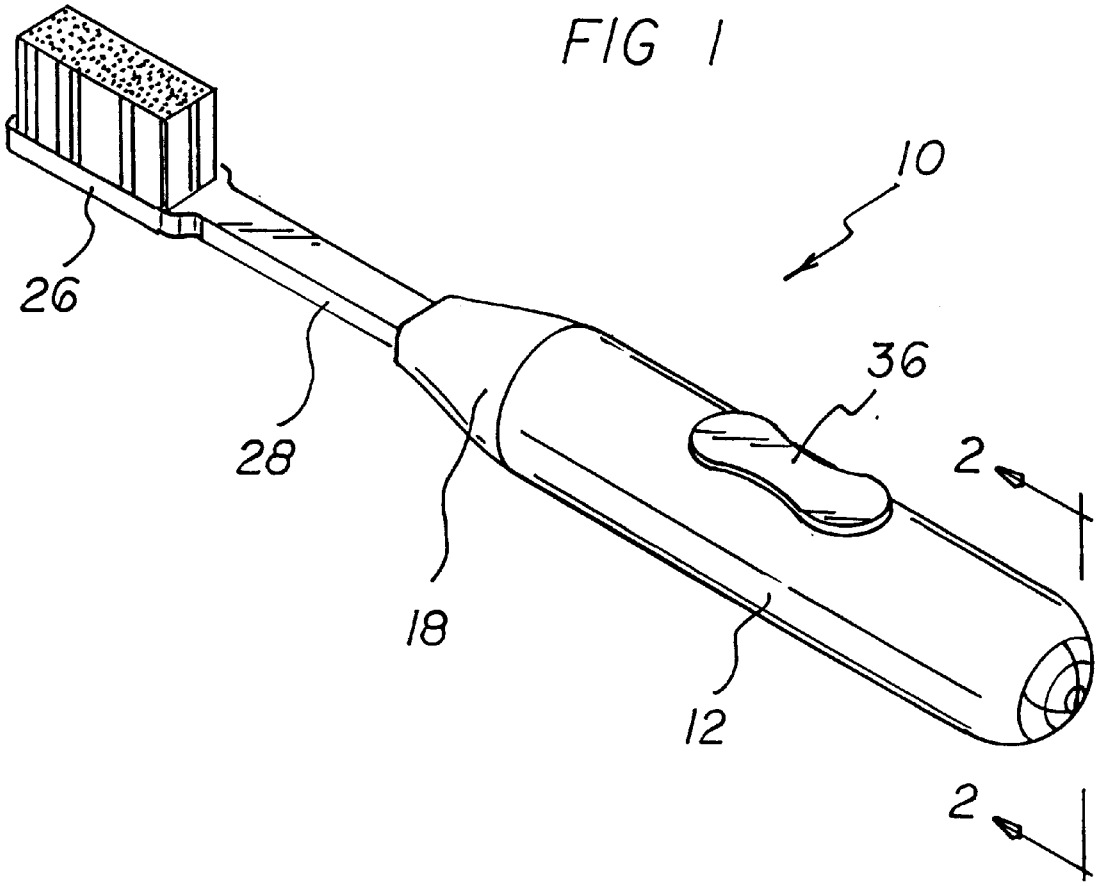
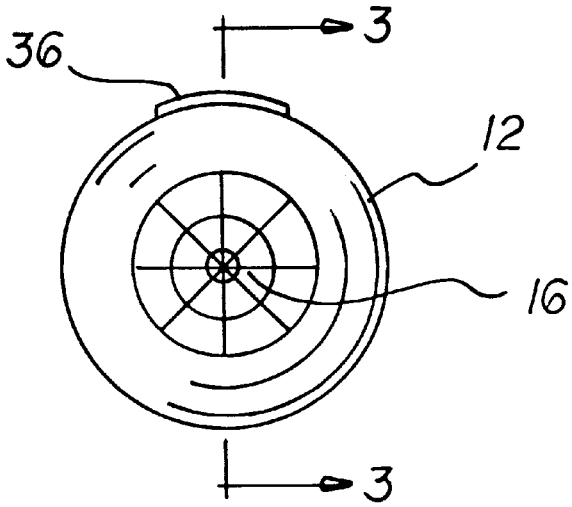
FIG 2

MUSICAL TOOTHBRUSH

BACKGROUND OF THE INVENTION

1. Field of the Invention

The present invention relates to a musical toothbrush and more particularly pertains to playing a tune while brushing one's teeth with a musical toothbrush.

2. Description of the Prior Art

The use of toothbrushes is known in the prior art. More specifically, toothbrushes heretofore devised and utilized for the purpose of brushing teeth are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,138,733 to Bock; U.S. Pat. No. 5,339,479 to Lyman; U.S. Pat. No. 4,866,807 to Kreit; and U.S. Pat. No. 5,259,086 to Fong.

While these devices fulfill their respective, particular objective and requirements, the aforementioned patents do not describe a musical toothbrush for playing a tune while brushing one's teeth.

In this respect, the musical toothbrush according to the present invention substantially departs from the conventional concepts and designs of the prior art, and in doing so provides an apparatus primarily developed for the purpose of playing a tune while brushing one's teeth.

Therefore, it can be appreciated that there exists a continuing need for new and improved musical toothbrush which can be used for playing a tune while brushing one's teeth. In this regard, the present invention substantially fulfills this need.

SUMMARY OF THE INVENTION

In the view of the foregoing disadvantages inherent in the known types of toothbrushes now present in the prior art, the present invention provides an improved musical toothbrush. As such, the general purpose of the present invention, which will be described subsequently in greater detail, is to provide a new and improved musical toothbrush and method which has all the advantages of the prior art and none of the disadvantages.

To attain this, the present invention essentially comprises a handle having a generally cylindrical configuration. The handle has an internally threaded open upper end and an open lower end with a mesh matrix therein. The handle has a kidney shaped opening formed therein intermediate the upper and lower ends thereof. The handle has a hollow interior. A coupling member is provided having a generally frustoconical configuration. The coupling member has an enlarged lower end having external threads thereon for coupling with the internally threaded open upper end of the handle. An upper end of the coupling member has a recess extending inwardly thereof. A brush portion is provided for detachably mating with the coupling member. The brush member has a shaft member extending therefrom. A lower end of the shaft member is dimensioned for receipt within the recess of the coupling member. A digital sound generator is disposed within the hollow interior of the handle. The digital sound generator is coupled with a power source positioned within the hollow interior of the handle. The power source is disposed interiorly of the open upper end. A speaker is disposed within the hollow interior of the handle. The speaker is positioned inwardly of the open lower end of the handle and directs audio sounds outwardly through the mesh matrix. An activation button couples with the digital sound generator. The activation button has a kidney shaped configuration for being received within the kidney shaped opening of the handle. Pressing inwardly on the activation button will activate the digital sound generator to emit a tune through the speaker and releasing the activation button will deactivate the digital sound generator.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

It is therefore an object of the present invention to provide a new and improved musical toothbrush which has all the advantages of the prior art toothbrushes and none of the disadvantages.

It is another object of the present invention to provide a new and improved musical toothbrush which may be easily and efficiently manufactured and marketed.

It is a further object of the present invention to provide a new and improved musical toothbrush which is of durable and reliable construction.

An even further object of the present invention is to provide a new and improved musical toothbrush which is susceptible of a low cost of manufacture with regard to both materials and labor, and which accordingly is then susceptible of low prices of sale to the consuming public, thereby making such a musical toothbrush economically available to the buying public.

Even still another object of the present invention is to provide a new and improved musical toothbrush for playing a tune while brushing one's teeth.

Lastly, it is an object of the present invention to provide a new and improved musical toothbrush including a handle. A coupling member couples with an open upper end of the handle. A brush portion detachably mates with the coupling member. A digital sound generator is disposed interiorly of the handle. The digital sound generator is coupled with a power source positioned within the handle. A speaker is disposed within the handle. An activation button couples with the digital sound generator. Pressing inwardly on the activation button will activate the digital sound generator to emit a tune through the speaker and releasing the activation button will deactivate the digital sound generator.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein:

FIG. 1 is a perspective view of the preferred embodiment of the musical toothbrush constructed in accordance with the principles of the present invention.

FIG. 2 is an end view of the present invention as taken along line 2—2 of FIG. 1.

The same reference numerals refer to the same parts through the various figures.

DESCRIPTION OF THE PREFERRED EMBODIMENT

Figure 3:
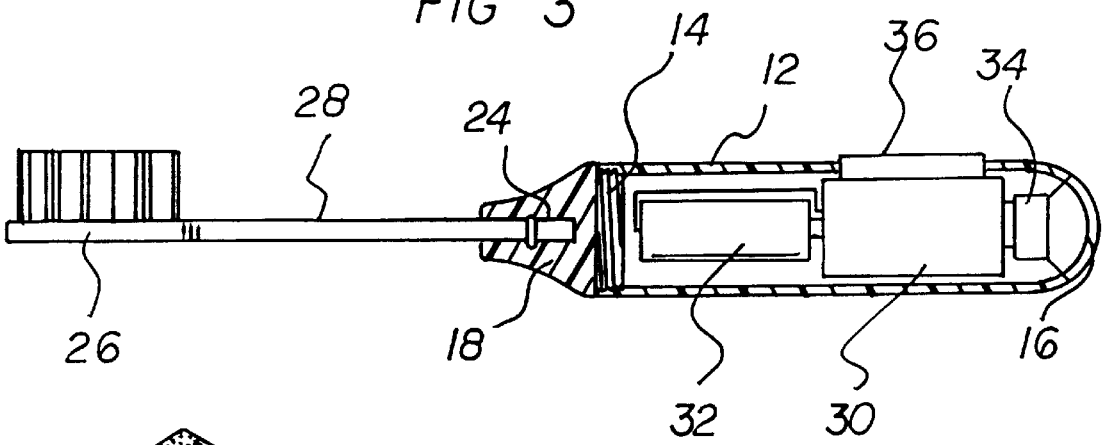
FIG. 3 is a cross-sectional view of the present invention as taken along line 3—3 of FIG. 2.
Figure 4:
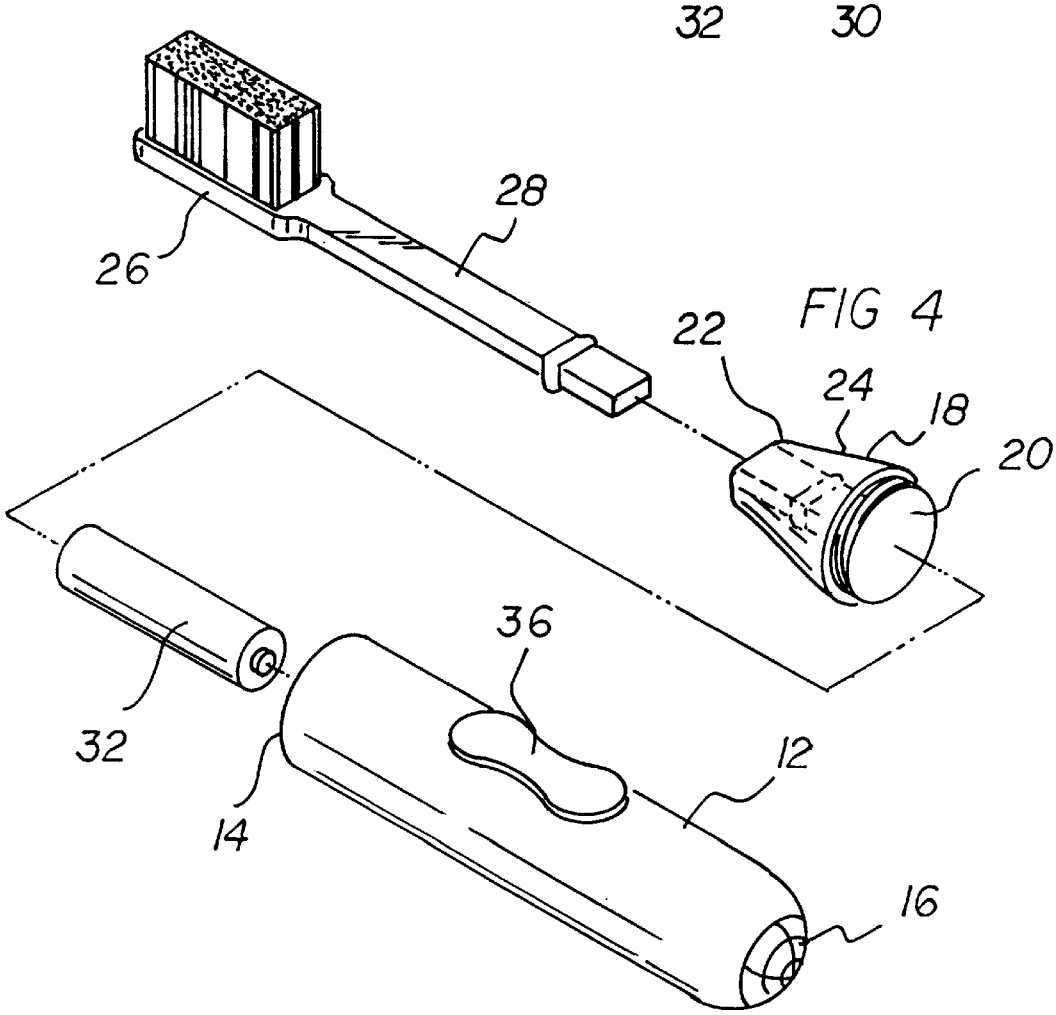
FIG. 4 is an exploded perspective view of the present invention.

With reference now to the drawings, and in particular, to FIGS. 1 through 4 thereof, the preferred embodiment of the new and improved musical toothbrush embodying the principles and concepts of the present invention and generally designated by the reference number 10 will be described.

Specifically, it will be noted in the various Figures that the device relates to a musical toothbrush for playing a tune while brushing one's teeth. In its broadest context, the device consists of a handle, a coupling member, a brush portion, a digital sound generator, a speaker, and an activation button. Such components are individually configured and correlated with respect to each other so as to attain the desired objective.

The handle 12 has a generally cylindrical configuration. The handle 12 has an internally threaded open upper end 14 and an open lower end with a mesh matrix 16 therein. The handle 12 has a kidney shaped opening formed therein intermediate the upper and lower ends thereof. The handle 12 has a hollow interior. The handle 12 is preferably constructed of a rigid plastic material and with an essentially waterproof interior.

The coupling member 18 has a generally frustoconical configuration. The coupling member 18 has an enlarged lower end 20 having external threads thereon for coupling with the internally threaded open upper end 14 of the handle 12. An upper end 22 of the coupling member 18 has a recess 24 extending inwardly thereof.

The brush portion 26 detachably mates with the coupling member 18. The brush member 26 has a shaft member 28 extending therefrom. A lower end of the shaft member 28 is dimensioned for receipt within the recess 24 of the coupling member 18.

The digital sound generator 30 is disposed within the hollow interior of the handle 12. The digital sound generator 30 is coupled with a power source 32 positioned within the hollow interior of the handle 12. The power source 32 is disposed interiorly of the open upper end 14. The power source 32 utilized in the preferred embodiment is a single AAA battery. The digital sound generator 30 can be programmed with a single tune or with a variety of tunes.

The speaker 34 is disposed within the hollow interior of the handle 12. The speaker 34 is positioned inwardly of the open lower end of the handle 12 and directs audio sounds outwardly through the mesh matrix 16.

The activation button 36 couples with the digital sound generator 30. The activation button 36 has a kidney shaped configuration for being received within the kidney shaped opening of the handle 12. Pressing inwardly on the activation button 36 will activate the digital sound generator 30 to emit a tune through the speaker 34 and releasing the activation button 36 will deactivate the digital sound generator 30.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. A musical toothbrush for playing a tune while brushing one's teeth comprising, in combination:

a handle having a generally cylindrical configuration, the handle having an internally threaded open upper end and an open lower end having a mesh matrix therein, the handle having a kidney shaped opening formed therein intermediate the upper and lower ends thereof, the handle having a hollow interior;

a coupling member having a generally frustoconical configuration, the coupling member having an enlarged lower end having external threads thereon for coupling with the internally threaded open upper end of the handle, an upper end of the coupling member having a recess extending inwardly thereof;

a brush portion detachably mating with the coupling member, the brush member having a shaft member extending therefrom, a lower end of the shaft member being dimensioned for receipt within the recess of the coupling member;

a digital sound generator disposed within the hollow interior of the handle, the digital sound generator being coupled with a power source positioned within the hollow interior of the handle, the power source being disposed interiorly of the open upper end;

a speaker disposed within the hollow interior of the handle, the speaker being positioned inwardly of the open lower end of the handle and directing audio sounds outwardly through the mesh matrix;

an activation button coupling with the digital sound generator, the activation button having a kidney shaped configuration for being received within the kidney shaped opening of the handle;

whereby pressing the activation button inwardly will activate the digital sound generator to emit a tune through the speaker and releasing the activation button will deactivate the digital sound generator.

2. A musical toothbrush for playing a tune while brushing one's teeth comprising, in combination:

a handle;

a coupling member coupling with an open upper end of the handle, said member having a generally frustoconical configuration and an enlarged lower end having external threads thereon for coupling with an internally threaded open upper end of the handle, an upper end of the coupling member having a recess extending inwardly thereof;

a brush portion detachably mating with the coupling member;

a digital sound generator disposed interiorly of the handle, the digital sound generator being coupled with a power source positioned within the handle;

a speaker disposed within the handle;

an activation button coupling with the digital sound generator;

whereby pressing the activation button inwardly will activate the digital sound generator to emit a tune through the speaker and releasing the activation button will deactivate the digital sound generator.

3. The musical toothbrush as set forth in claim 2 wherein the brush portion has a shaft member extending therefrom, a lower end of the shaft member being dimensioned for receipt within the recess of the coupling member.

* * * * *